United States Patent [19]

Aihara et al.

[11] Patent Number: 4,859,154

[45] Date of Patent: Aug. 22, 1989

[54] VARIABLE-DELIVERY VANE-TYPE ROTARY COMPRESSOR

[75] Inventors: Toshinori Aihara; Yukio Sudo, both of Atsugi, Japan

[73] Assignee: Atsugi Motor Parts Co., Ltd., Kanagawa, Japan

[21] Appl. No.: 83,267

[22] Filed: Aug. 5, 1987

[30] Foreign Application Priority Data

Aug. 7, 1986 [JP] Japan ..... 61-186555

[51] Int. Cl.[4] ..... F04B 49/00; F04B 49/02

[52] U.S. Cl. ..... 417/295; 417/310

[58] Field of Search ..... 417/295, 310, 440; 418/78

[56] References Cited

U.S. PATENT DOCUMENTS

| | | | |
|---|---|---|---|
| 2,899,903 | 8/1959 | Rydor | 417/440 |
| 3,451,614 | 6/1969 | Tosh | 417/440 |
| 3,515,496 | 6/1970 | Eddy | 417/440 |
| 3,799,707 | 7/1974 | Newton | 418/78 |
| 4,060,343 | 11/1977 | Newton | 417/310 |
| 4,137,018 | 1/1979 | Brucken | 417/440 |
| 4,557,670 | 12/1985 | Inagaki | 417/310 |
| 4,726,740 | 2/1988 | Suzuki et al. | 417/298 |
| 4,778,352 | 10/1988 | Nakajima | 417/295 |

FOREIGN PATENT DOCUMENTS

| | | | |
|---|---|---|---|
| 174516 | 3/1986 | European Pat. Off. | 417/310 |
| 3629199 | 3/1987 | Fed. Rep. of Germany | 417/310 |
| 115150 | 12/1975 | Japan | 417/295 |
| 157090 | 9/1982 | Japan | 417/440 |
| 259789 | 12/1985 | Japan | 417/295 |

*Primary Examiner*—William L. Freeh

[57] ABSTRACT

A variable-delivery vane-type rotary compressor includes means for controlling discharge by-passed from an actuating chamber and an inhalator chamber by changing area of opening provided between a front plate and a cam ring. The means can control discharge by rotation of a disc having at least one by-pass opening. The disc can rotate in accordance with signals produced from at least one sensor.

3 Claims, 5 Drawing Sheets

VARIABLE-DELIVERY VANE-TYPE ROTARY COMPRESSOR

BACKGROUND OF THE INVENTION

1. Field of the Invention

The present invention relates to a variable-delivery vane-type rotary compressor, particularly to a rotary compressor which is used as a refrigerant compressor for an air conditioner for a vehicle or the like.

2. Description of the Prior Art

Generally, in order to control discharge in a vane-type rotary compressor, an inlet port being in communication with the interior of a cam ring is provided on a side-block which covers one end of the cam ring. The position of the opening is moved along a cam surface so that due to the rotation of the vanes the compression starting position is changed.

Such variable-delivery vane-type rotary compressors are described in the Japanese Patent First Publication (Jikkai) Showa No. 59-76786 and the Japanese Patent First Publication (Tokkai) Showa No. 60-259789. The former is provided with a control disc between the cam ring and the side-block. The control disc is provided with a circular inlet port opposing an actuating chamber. The control disc rotates about the axis of a rotor so that the position of the inlet port can be changed. On the other hand, the latter has a cam ring provided with an inlet port, the end opening of which is provided on the inside surface. In addition one end of the cam ring is provided with a side-block. A arc-shaped inlet port, which extends beside the cam surface, is formed on the side-block. A slide control member is slidably inserted into the inlet port of the side-block. By moving the position of the control member, compression starting position of the vane can be changed.

However, in these conventional variable-delivery vane-type rotary compressors, aperture area of the inlet port can not be enlarged. Therefore, when discharge is controlled by changing the position of the inlet port and delaying the compression starting position of the vane, negative pressure occurs in rear of the vane until the vane reaches the inlet starting point. Therefore, there is a disadvantage in that power loss is increased due to the pressure differential between the front and rear of the vane.

On the other hand, when the side-block is provided with an inlet port and a slide control member other than the inlet port provided on the cam ring, there is no power loss. However, since the inlet port can not be formed in all of the actuating chambers, the variable range of discharge is small (for example, about 50 to 100%). Therefore, there is a disadvantage in that good driving condition can not be achieved since ON-OFF of the clutch due to supercooling of the air conditioner during high-speed operation of the engine or ON-OFF of the clutch when low-load is applied to the air conditioner can not be prevented.

SUMMARY OF THE INVENTION

It is therefore a principal object of the present invention to eliminate the aforementioned disadvantages and to provide a variable-delivery vane-type rotary compressor which can decrease power loss due to pressure differential between the front and rear of the vanes and which can increase the variable range of discharge. Another object of the invention is to provide a variable-delivery vane-type rotary compressor which can decrease fuel cost for an engine and achieve good driving conditions.

In order to accomplish the aforementioned and other specific objects, a variable-delivery vane-type rotary compressor includes means for controlling discharge by-passed from an actuating chamber and an inhalator chamber by changing area of opening provided between a front plate and a cam ring. The means comprises:

at least one inlet provided in the front plate;

at least one inlet port provided in the cam ring and which is in communication with the inhalator chamber by means of the inlet, the end opening of which is adjacent to the cam surface of the cam ring so that the communication between the inhalator chamber and the actuating chamber when the volume of the actuating chamber defined by the adjoining vanes is maximal;

at least one arc-shaped by-pass port provided in the front plate along the cam surface, the end opening of which may open on any radial section of the actuating chamber;

a rotatable disc which is provided between the front plate and the cam ring and which can rotate along the cam surface; and at least one by-pass opening which is formed in the rotatable disc and which establishes the communication between the actuating chamber and the inhalator chamber with the by-pass port, the by-pass opening being moved relative to the by-pass port so as to control discharge by-passed from the actuating chamber to the inhalator chamber.

According to one aspect of the present invention, the variable-delivery vane-type rotary compressor comprising:

a cam ring, the interior of which is provided with a cam surface;

a front plate covering the front end opening of the cam ring;

a rear plate covering the rear end opening of the cam ring;

a rotor rotatably housed in the cam ring between the front and rear plates;

at least one actuating chamber formed by the cam ring, and the front and rear plates and the rotor;

a plurality of vanes inserted into the rotor, the vanes being movable inwardly and outwardly, the tips of which can slide in contact with the cam surface;

a housing having a bottom, in which the cam ring, the front and rear plates, the rotor and the vanes housed;

a head cover with covers the end opening of the housing;

an inhalator chamber formed by the head cover and the front plate; and at least one inlet provided in the front plate;

at least one inlet port provided in the cam ring and which is in communication with the inhalator chamber by means of the inlet, the end opening of which is opposed to the cam surface so that the communication between the inhalator chamber and the actuating chamber when the volume of the actuating chamber defined by the adjoining vanes is maximal;

at least one arc-shaped by-pass port provided in the front plate along the cam surface, the end opening of which can open on any radial section of the actuating chamber;

a rotatable disc which is provided between the front plate and the cam ring and which can rotate along the cam surface; and at least one by-pass opening formed in the rotatable disc and which establish the communication between the actuating chamber and the inhalator chamber with the by-pass port, the by-pass opening being movable relative to the by-pass port so as to control discharge by-passed from the actuating chamber to the inhalator chamber.

The rotatable disc can rotate in accordance with signals produced from at least one sensor so as to change the position of the by-pass opening relative to the by-pass port.

The sensor can detect inlet pressure, evaporation pressure of an evaporator, temperature of inlet refrigerant, evaporation temperature of the evaporator, temperature of the vehicle body, surrounding temperature or the like to produce signals in order to rotate said rotatable disc.

BRIEF DESCRIPTION OF THE DRAWINGS

The present invention will be understood more fully from the detailed description given herebelow and from the accompanying drawings of the preferred embodiment of the invention. The drawings are not intended to imply limitation of the invention to this specific embodiment, but are for explanation and understanding only.

In the drawings.

DESCRIPTION OF THE PREFERRED EMBODIMENT

Figure 1:
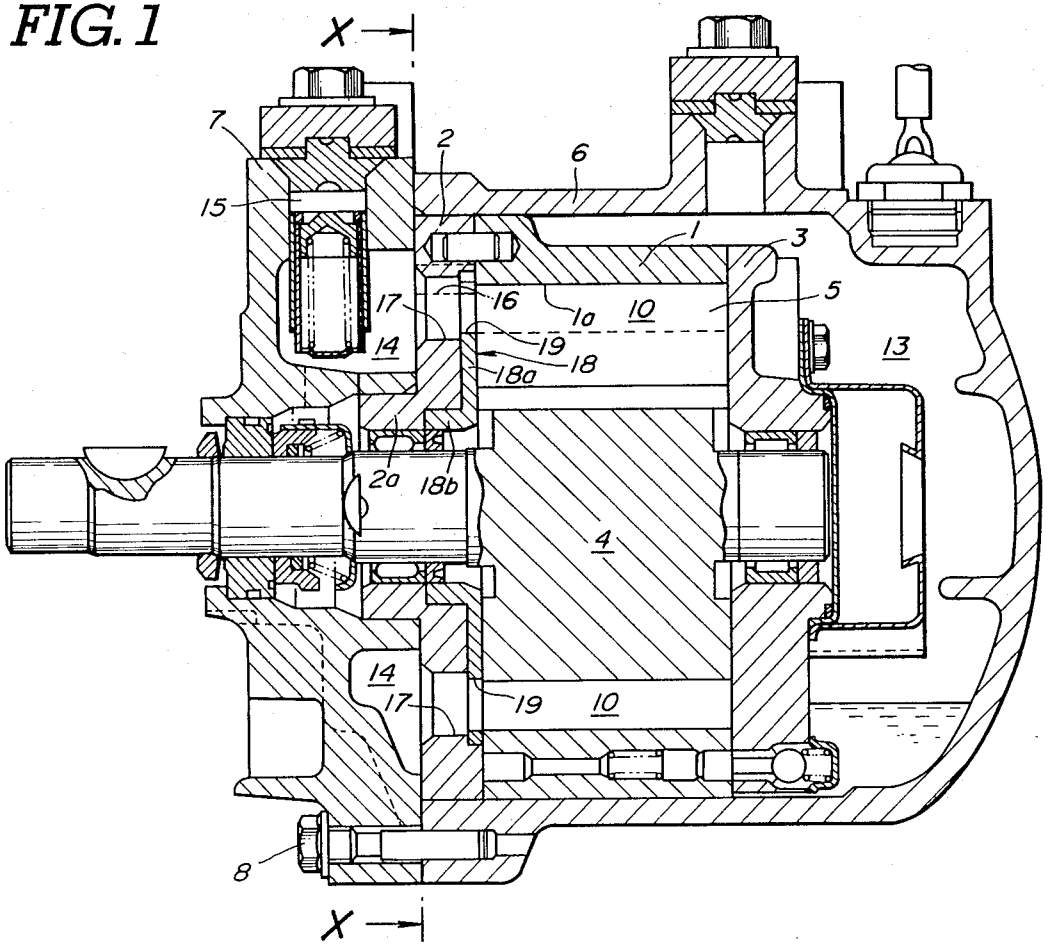
FIG. 1 is a sectional view of the preferred embodiment of a variable-delivery vane-type rotary compressor according to the present invention.

Referring now to the drawings, particularly to FIG. 1, a variable-delivery vane-type rotary compressor, according to the present invention, includes a cylindrical cam ring 1. A cam surface 1*a*, which has an essentially elliptical cross section, is formed on the inside surface of the cam ring 1. The cam ring 1 is equipped with front and rear plates 2 and 3 at both of open ends in order to cover the open end of the cam ring 1. A cylindrical rotor 4 is rotatably housed in the cam ring 1 between the front and rear plates 2 and 3. A plurality of vanes 5 are inserted into the rotor 4. The vanes 5 can move inwardly and outwardly so as to be in slidable contact with the cam surface 1*a*. The cam ring 1, the front and rear plates 2 and 3, the rotor 4 and vanes 5 are housed in a cylindrical housing 6 having a bottom. The front open end the housing 6 is covered with a head cover 7 which is fixed to the housing 6 by means of a bolt 8.

Figure 2:
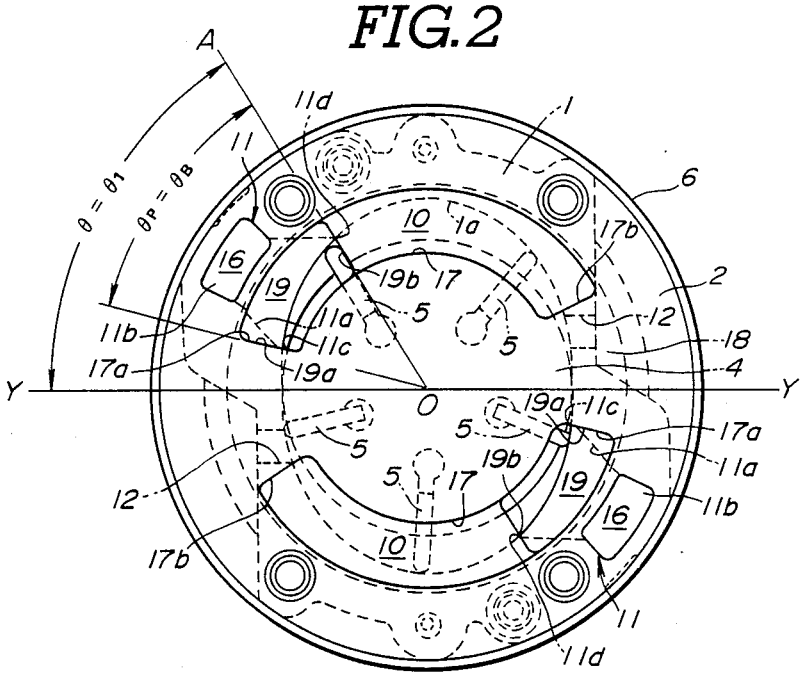
FIGS. 2 to 4 are sectional views of the compressor taken along the line X—X in FIG. 1, which show the compressor in the maximum, medium and minimum discharge, respectively.

By the cam ring 1, the front and rear plates 2 and 3 and the rotor 4, a pair of actuating chambers 10 are formed. As shown in FIG. 2, the actuating chambers 10 respectively are in communication with a pair of inlet ports 11, the end openings of which are formed on the cam surface 1*a*. The communication between the inlet port 11 and the actuating chamber 10 is blocked when the actuating chamber 10 is divided to maximize the volume thereof. Each of the inlet ports 11 comprises a plurality of openings 11*a*, the end openings of which are formed on the cam surface 1*a* of the cam ring 1, and an opening 11*b* which extends from the outer surface of the cam ring 1 to pass through the front plate 2 so as to be in communication with an inhalator chamber 14. In addition, a pair of discharge ports 12 is formed on the cam ring 1 at a location corresponding to the clockwise end of the actuating chamber 10. The communication between a discharge chamber 13, which is formed in the housing 6, and the actuating chamber 10 is established by means of a discharge valve provided in the discharge port 12.

The inhalator chamber 14 is formed by the front plate 2 and the head cover 7. The head cover 7 is provided with an inlet 15 through which a refrigerant gas is supplied to the inhalator chamber 14. The refrigerant gas is supplied to the respective actuating chambers 10 through a pair of inlets 16, which are formed on the front plate 2, and the circumferential inlet port 11.

Figure 5:
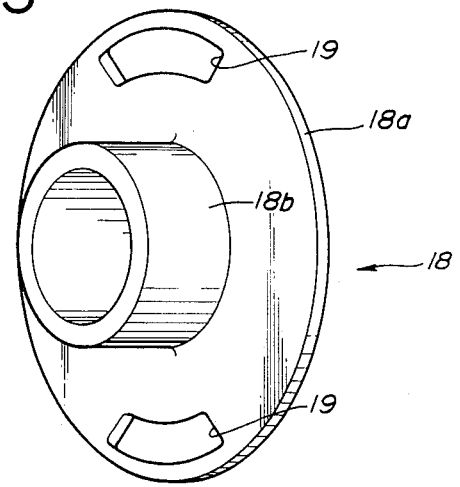
FIG. 5 is a perspective view of a rotatable disc used in the compressor.

In addition, a pair of arc-shaped by-pass ports 17 are formed on the front plate 2. As shown in FIG. 2, the by-pass port 17 extends essentially throughout the actuating chamber 10 along the cam surface 1*a* from the verge 11*c*, in which the opening 11*a* of the inlet port 11 is formed on the actuating chamber 10, to near the discharge port 12 so as to establish the communication between the actuating chamber 10 and the inhalator chamber 14. Between the front plate 2, cam ring 1 and rotor 4, a rotatable disc 18 which comprises a plate portion 18*a* and a boss portion 18*b* shown in FIG. 5, are provided. The boss portion 18*b* is rotatably in contact with a boss portion 2*a* of the front plate 2. The rotatable disc 18 is moved by means of an actuator and rotates along the cam surface 1*a*. As show in FIG. 5, the plate portion 18*a* of the rotatable disc 18 is provided with a pair of arc-shaped by-pass openings 19 which establishes the communication between the actuating chamber 10 and the inhalator chamber 14.

Figure 4:
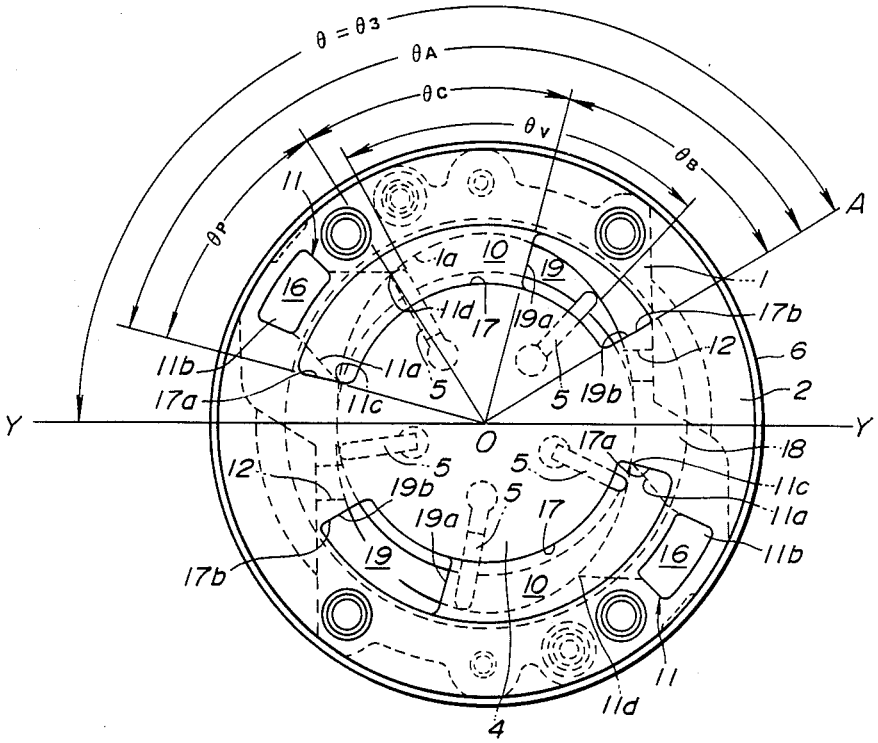

As shown in FIG. 2, the angle $\theta_B$ between the counterclockwise and clockwise verges 19*a* and 19*b* of the by-pass opening 19 is equal to the angle $\theta_P$ between both ends of the openings 11*a* of the inlet port 11. As shown in FIG. 4, when the clockwise verge 19*b* of the by-pass opening 19 corresponds to the clockwise verge 17*b* of the by-pass port 17 after the rotatable disc 18 rotates clockwise, the angle $\theta_C$ between the verge 11*d* of the opening 11*a* of the inlet port 11 and the counterclockwise verge 19*a* of the by-pass opening 19, i.e. the discontinuous angle between the inlet port 11 and the by-pass opening 19 is less than the angle $\theta_V$ between the adjacent vanes 5 (vane included angle). Therefore, when the angle between the counterclockwise and clockwise verges 17*a* and 17*b* of the by-pass port 17, i.e. the opening angle of the by-pass port 17 is assumed to be $\theta_A$, $\theta_V > \theta_C = \theta_A - \theta_P - \theta_B$. For example, when the number of the vanes is assumed to be 5, the vane included angle $\theta_V 360°/5 = 72°$. In addition, when $\theta_A = 135°$ and $\theta_B = \theta_P = 45°$, the discontinuous angle $\theta_C = \theta_A - \theta_B - \theta_P = 45°$ and there is the vane included angle $\theta_V > \theta_C$.

Figure 3:
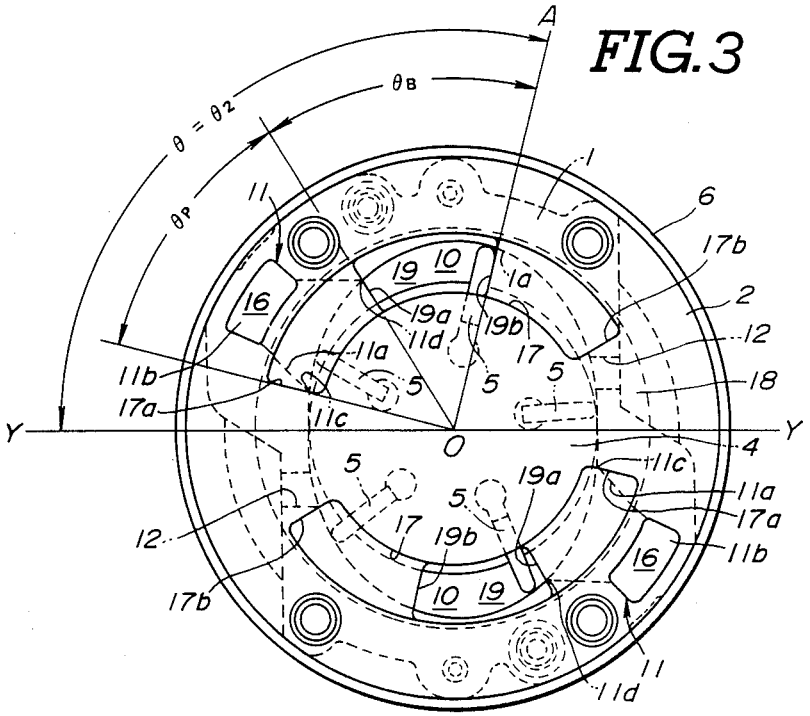

FIGS. 2 to 4 show change of the position the by-pass opening 19 relative to the by-pass port 17. In FIG. 2, the by-pass opening 19 corresponds to the openings 11*a* of the inlet port 11. In FIG. 3, the counterclockwise verge 19*a* of the by-pass opening 19 corresponds to the clockwise verge 11*d* of the openings 11*a* of the inlet port 11. In FIG. 4, the clockwise verge 19*b* of the by-pass opening 19 corresponds to the clockwise verge 17*b* of the by-pass port 17.

The rotating shaft of the rotor 4 is connected to an engine of a vehicle or the like to be actuated. When the rotor is actuated to rotate clockwise in FIG. 2, the vanes 5 projects radially due to centrifugal force and back pressure of the vanes. As a result, the tips of the vanes 5 remain in contact with the cam surface 1*a* of the cam ring 1 as they rotate. On the other hand, the aforementioned actuator is actuated in accordance with signals produced from various sensors due to inlet pressure, evaporation pressure of an evaporator, temperature of inlet refrigerant, evaporation temperature of the evaporator, temperature of the vehicle body, surrounding temperature, or the like. As a result, the rotatable disc 18 rotates so that the position of the by-pass opening 19 is changed relative to the by-pass port 17.

In FIG. 2, the by-pass opening 19 corresponds to the openings 11*a* of the inlet port 11. In this case, refrigerant gas is supplied to the actuating chamber 10 through the inlet port 11 and the by-pass opening 19 in accordance with rotation of the vanes 5. After the vane 5 reaches the compression starting point shown by the line O-A, compression process begins. In this case, since refrigerant gas is compressed to be discharged through the discharge port 12 without the by-pass, the amount of discharged refrigerant is maximal.

In FIG. 3, the by-pass opening 19 adjoins the openings 11*a* of the inlet port 11 to as to open the actuating chamber 10. The compression starting point is shifted clockwise by $\theta_B$ relative to the point shown in FIG. 2. Therefore, since a part of refrigerant gas is by-passed into the inlet chamber 14 through the by-pass opening 19, the amount of discharged refrigerant is medium. In this case, inlet pressures applied to the regions in front and rear of the vane 5 are equal to each other when the vane 5 passes through the minimal diameter portion of the cam ring 1, since refrigerant gas is supplied through the inlet port 11 at first and through the by-pass opening 19 subsequently. Therefore, there is no power loss.

In FIG. 4, the distance between the by-pass opening 19 and the clockwise verge 17*b* of the by-pass port 17 is the shortest so that the compression starting point corresponds to the clockwise verge 17*b*.

Therefore, since most of the refrigerant gas is by-passed into the inlet chamber 14 through the by-pass opening 19, the amount of discharged refrigerant gas is minimal. In this case, the actuating chamber 10 in front and rear of the vane 5, by which compression work is not performed, is always in communication with the inlet chamber 14 through the inlet port 11 or the by-pass opening 19. Therefore, it is possible to decrease power loss since pressure differential does not occur in front and rear of the vane 5.

Referring to FIGS. 6 to 9, the changes of discharge in accordance with the position of the by-pass opening 19 relative to the by-pass port 17 are described.

Figure 6:
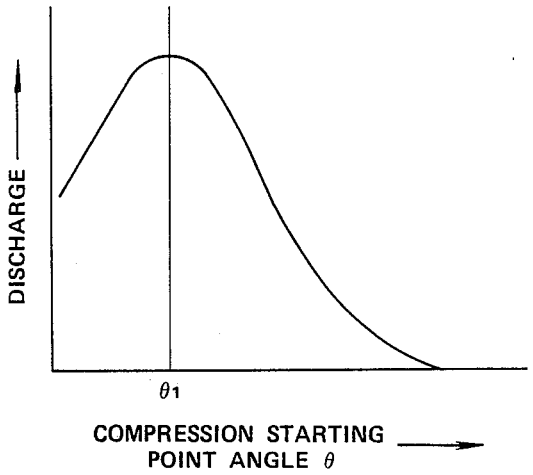
FIG. 6 is a graph showing a relationship between discharge and compression starting point angle.
Figure 7:
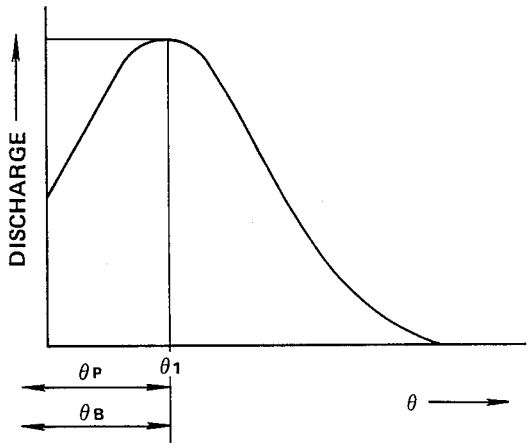
FIGS. 7 to 9 are graphs showing relationship between discharge and compression starting point angle in the maximum, medium and minimum discharge.
Figure 8:
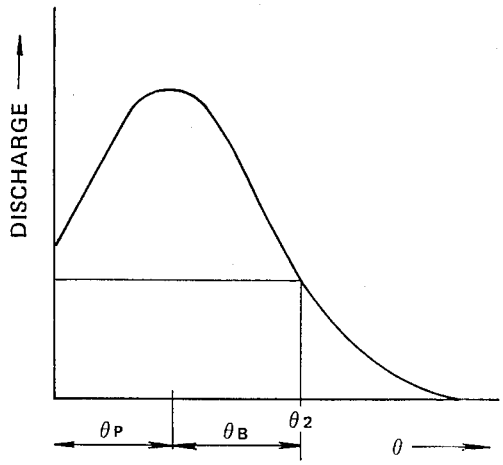
Figure 9:
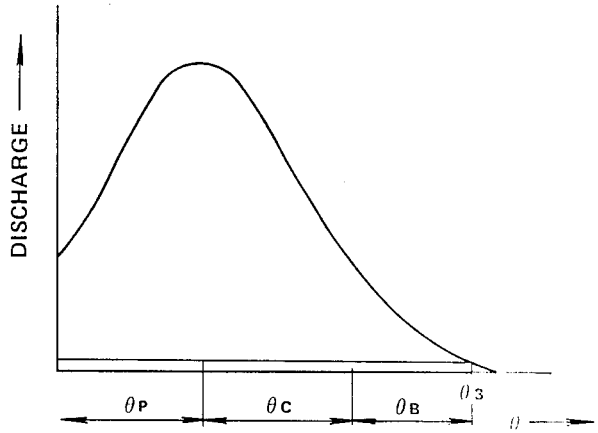

FIG. 6 shows a relationship between angle between the axis of abscissa Y-Y and the line O-A showing the compression starting point in FIGS. 2 to 4, i.e. compression starting point angle $\theta$, and discharge. As shown in FIG. 6, discharge is maximal when the O-A line corresponds to the clockwise verge 11*d* of the openings 11*a* of the inlet port 11, i.e. $\theta=\theta_1$ (See FIG. 2). FIG. 7 shows discharge when $\theta_P=\theta_B$ and the compression starting point angle $\theta=\theta_1$, which corresponds to FIG. 2. In this case, the discharge is maximal. FIG. 8 shows discharge when the compression starting point is shifted from $\theta_P$ by $\theta_B$ and $\theta=\theta_2$, which corresponds to FIG. 3. In this case, the discharge is medium. In addition, FIG. 9 shows discharge when the compression starting point is shifted from $\theta_P$ by $\theta_C+\theta_B$, which corresponds to FIG. 4. In this case, the discharge is minimal.

As mentioned above, according to the present invention, the arc-shaped by-pass opening 19 formed on the rotatable disc 18 can be moved relative to the by-pass port 17 so that the compression starting point can be successively changed. Therefore, the variable range can be increased to achieve the change from essentially 0 to 100%. In addition, it is possible to decrease power loss due to pressure differential in front and rear of the vane since the vane included angle $\theta_V$ is larger than the discontinuous angle $\theta_C$. As a result, it is possible to decrease fuel cost for an engine and obtain good driving conditions.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. A variable capacity rotary compressor comprising:

(a) a compressor housing defining therein an internal space which includes a low-pressure chamber connected to a low-pressure fluid source and a high-pressure chamber connected to a load;

(b) introducing means for introducing a low-pressure fluid into said low-pressure chamber;

(c) compression means for compressing said low-pressure fluid to a predetermined higher pressure, said compression means including a compression chamber into which said low-pressure fluid is introduced for compression, said compression means including a rotor assembly carrying a plurality of vanes which are provided radially for radial movement toward and away with respect to said rotor assembly for defining a plurality of arcuately arranged compression chambers, said rotor being driven to rotate for repeating operation cycles including introduction stroke for introducing said low-pressure fluid, compression stroke for the introduced low-pressure fluid and discharge stroke for compressed high pressure fluid to said high-pressure chamber;

(d) first inlet communicating the low pressure chamber and compression chamber, said first inlet acting solely as an inlet port during all operations of the variable capacity rotary compressor;

(e) passage means for defining a by-pass passage located between the low-pressure chamber and compression chamber for establishing communication between said low-pressure chamber and said compression chamber, said by-pass passage extending substantially the entire arcuate length of the compression chamber so as to establish communication between said low-pressure chamber and said compression chamber;

(f) rotary closure member defining an opening having an arcuate extent with loading and trailing edges wherein the leading edge defines the beginning of the compression point of the variable capacity compressor, said rotary closure member being selectively positioned between a first position wherein said opening serves only as an inlet for communicating low-pressure fluid from the low-pressure chamber to the compression chamber when said compressor operates at maximum capacity and a second position wherein said opening serves as a by-pass from the compression chamber through said by-pass passage to the low-pressure chamber when said compressor operates at a reduced capacity; and (g) actuating means for actuating said rotary closure member for movement between said first position and said second position for adjusting the amount of low-pressure fluid by-passed through said by-pass passage wherein the pressure on both sides of the vanes prior to the beginning of the pressure point is substantially equal whereby power losses resulting from pressure drops across the vanes is substantially reduced.

2. A rotary compressor as set forth in claim 1, wherein said rotary closure member comprises a disc-shaped member in which a by-pass opening is provided at the circumference thereof, said disc-shaped member being rotatably provided on an end wall of said compression chamber.

3. A rotary compressor as set forth in claim 2, wherein said by-pass opening is an arc-shaped opening extending beside the outer periphery and wherein said by-pass passage has a long arc-shaped sectional area corresponding to said by-pass opening.

* * * * *